US006307455B1

(12) United States Patent
Dolo et al.

(10) Patent No.: US 6,307,455 B1
(45) Date of Patent: Oct. 23, 2001

(54) CONTROL MECHANISM FOR A CIRCUIT BREAKER

(75) Inventors: Gerard Dolo, Saint-Germain-en-Laye; Dominique Millot, Nanterre; Frédéric Noirot, Marly-le-Roi, all of (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/685,063

(22) Filed: Oct. 10, 2000

(30) Foreign Application Priority Data

Oct. 11, 1999 (FR) ..... 99 12793

(51) Int. Cl.[7] ..... H01H 9/00

(52) U.S. Cl. ..... 335/172; 335/6; 335/21; 335/38; 335/166; 335/167; 335/174

(58) Field of Search ..... 335/6, 21, 22, 335/24, 25, 26, 27, 35, 36, 38, 166–175

(56) References Cited

U.S. PATENT DOCUMENTS 4,048,599 9/1977 Groth ..... 335/20
5,252,933 10/1993 Kamino et al. ..... 335/172

FOREIGN PATENT DOCUMENTS 0 571 258 11/1993 (EP) .
0 847 070 6/1998 (EP) .
2 538 160 6/1984 (FR) .

*Primary Examiner*—Ramon M. Barrera
(74) *Attorney, Agent, or Firm*—Oblon, Spivak, McClelland, Maier & Neustadt, P.C.

(57) ABSTRACT

Circuit breaker mechanism comprising a manually controlled part 40*a* acted upon by a knob 42 and a part 40*c* with an electromagnetic overcurrent tripping device 41 and a trip spring 65.

The parts 40*b*, 40*c* act on a common lever 43 through a connecting rod 62 and a control lever 66 respectively. The part 40*b* is coupled to a lever 64 onto which the spring 65 exerts a torque, and also applies an opening torque to lever 66.

8 Claims, 4 Drawing Sheets

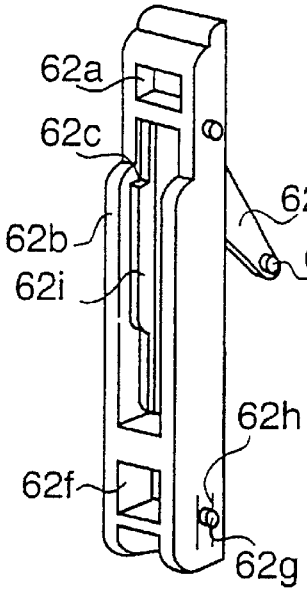
Fig 7
Fig 8
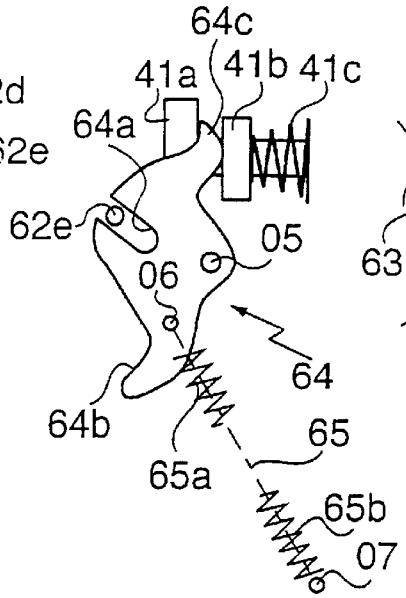
Fig 9
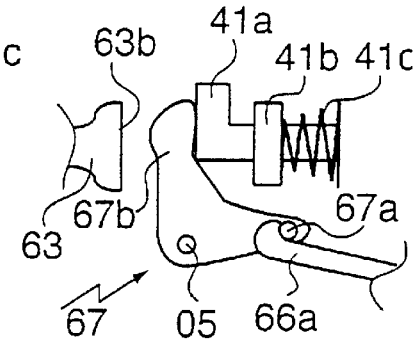
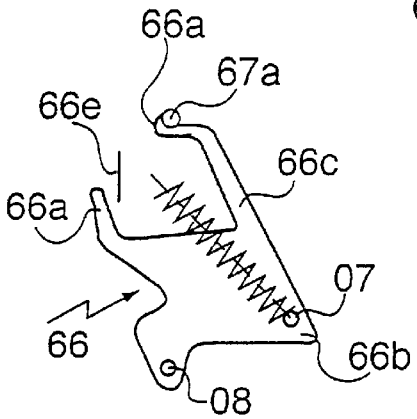
Fig 10
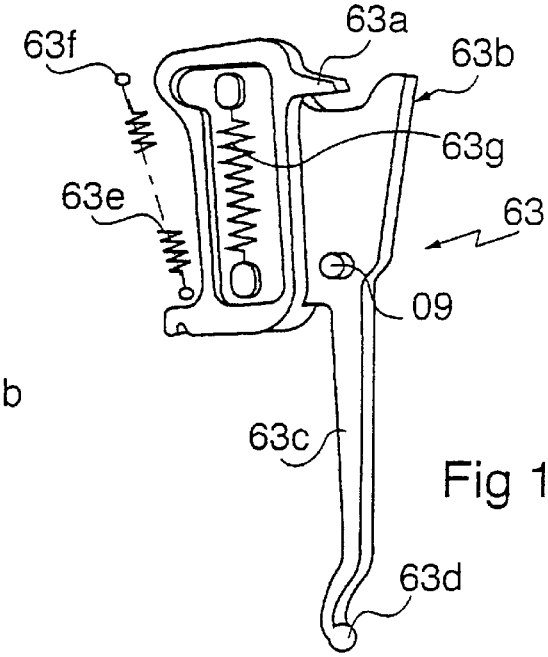
Fig 11

CONTROL MECHANISM FOR A CIRCUIT BREAKER

BACKGROUND OF THE INVENTION

This invention relates to a control mechanism for a circuit breaker comprising poles with separable contacts.

This type of mechanism usually includes a manual control part used to start and stop and reset, and a trip part comprising an electromagnetic tripping device, a pivoting latch-in lever, and a pivoting control lever with a pawl normally held in place by the latch and acted upon by a trip spring, the tripping device pivoting the latch-in lever and unlatching the control lever to open the contacts, in response to an overcurrent.

In a particular circuit breaker called "contactor-circuit breaker" or hereafter circuit interrupter, the mechanism must also include a part for switching the contacts using an electromagnet depending on whether or not the electromagnet coil is energized.

SUMMARY OF THE INVENTION

The purpose of this invention is to simplify such a circuit breaker mechanism by having some of its component parts perform several functions.

According to the invention, an oscillating lever is installed free to pivot on a hinge pin and is coupled with the manual control part, while the trip spring exerts an opening torque on the control lever through a first bearing point and a return torque on the oscillating lever through a second bearing point. The double-acting trip spring is preferably a compression spring, and the second spring bearing point is put into the On position slightly offset from the line between its first bearing point and the hinge pin of the oscillating lever, and when tripping takes place the offset forces the oscillating lever into an intermediate position between its On position and its Stop position.

The manual control part advantageously comprises a knob and a sliding connecting rod cooperating directly with the oscillating lever and coupled to a multipole contact actuator lever, the connecting rod and the knob being able to move into an On position, a Stop position and an intermediate trip position.

The sliding connecting rod may be used with a pivoting lock, this lock being able to lock the connecting rod in the On position and is provided with an arm coupled to a strip designed to move the auxiliary contacts, and transferring three positions ("On", "Off" and "Tripped") to the strip. The manual control part is coupled to a single sliding strip with three positions (On, Off and Tripped) to activate at least one signaling device.

BRIEF DESCRIPTION OF THE DRAWINGS

The following description relates to a non-limitative embodiment of the invention with reference to the attached drawings.

FIG. 7 shows a perspective view of the manual control mechanism rod.

FIGS. 8 and 9 are diagrammatic views of the oscillating lever and the latch-in lever.

FIG. 10 is a diagrammatic view of the control lever.

FIG. 11 illustrates the lock on the manual control rod in perspective.

DESCRIPTION OF THE PREFERRED EMBODIMENT

Figure 1:
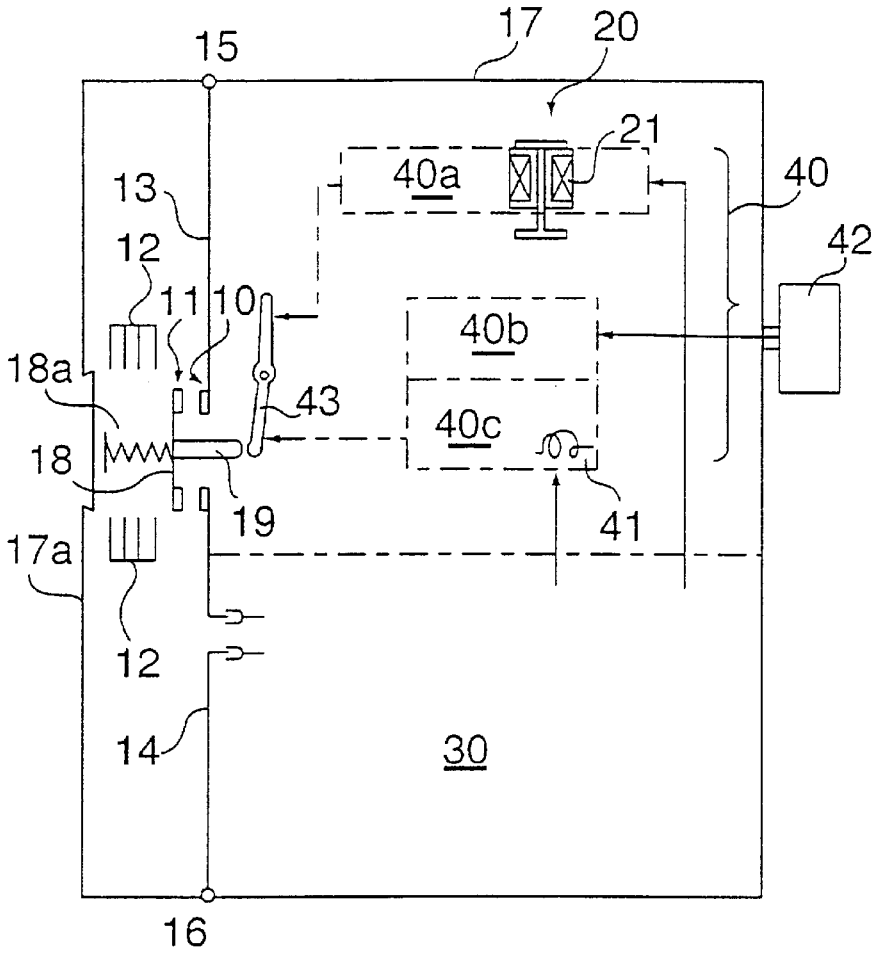
FIG. 1 is a diagram of a circuit breaker conform with the invention.

The circuit breaker shown in FIG. 1 comprises several contact poles fitted with fixed contacts 10 and mobile contacts 11 associated with extinguishing chambers 12. The fixed contacts 10 are connected by power conductors 13, 14 to source power terminals 15 and load power terminals 16 placed in the equipment housing 17 or on terminal blocks fitted on the equipment. The contact poles are of the double break type and therefore the mobile contacts 12 are placed on a bridge 18 moved in the closing direction by the action of a spring 18*a* and in the opening direction by the action of a device driving a pusher 19 associated with each pole.

The casing 17 of the circuit breaker comprises a single block or a set of casings assembled to each other, forming a rear attachment face 17*a* to be connected to a support. It comprises an electromagnet 20 and an electronic protection device 30, that is designed to act on the pushers 19 for the various poles to open and close the contacts.

In the case of an overload or overcurrent, the protection device 30 controls an electromagnetic tripping device 41 with intermittent action. The core of the electromagnetic trip 41 acts on a lever of a lock belonging to a contact control mechanism 40 through a pusher 41*a*; the pusher 41*a* has a lateral contact surface 41*b* that facilitates its return to its rest position and it is moved into its tripped position by a spring 41*c*.

A manual control knob 42 that can be placed in an On position or an Off position operates with mechanism 40 to control switching of contacts 11. Obviously, it would be possible to use two knobs, one On knob and one Off knob, for manual control. The control mechanism 40 includes a bistable automatic control part 40*a* controlled by the electromagnet 20 starting from an On or Off order transferred to its terminals, a manual control part 40*b* controlled directly by knob 42 and a trip part 40*c* controlled by the electromagnetic tripping device 41 and cooperating reciprocally with the manual control part 40*b*. Note that the three parts 40*a, b, c* of the mechanism 40 act on a common pivoting lever 43. This is a multipole lever which is mounted to pivot about a fixed axis O1 and has two arms 43*a*, 43*b*. Arm 43*a* is coupled to mechanism 40*b* and arm 43*b* is acted upon by a lever not shown driven by electromagnet 20 through a lever not shown and by a control lever 66 that can be moved by the tripping device 41. Arm 43*b* has one free end 44 that comes into contact with the top of the various polar pushers 19 to open the contacts when one of the parts 40*a*, 40*b*, 40*c* of the mechanism is acted upon.

The manual control part 40*b* of the mechanism 40 comprises a transfer system 61 that transforms the rotation movement of knob 42 (about axis O3) into a translation movement along a direction X2 parallel to the displacement of the pushers 19, and connecting rod 62 that moves along this same direction X2. In particular, the return system 61 includes a rotating finger 61*a* fitted on an axis O4 providing mechanical coupling with the connecting rod.

Figures 6A, 6B, 6C, 6D:
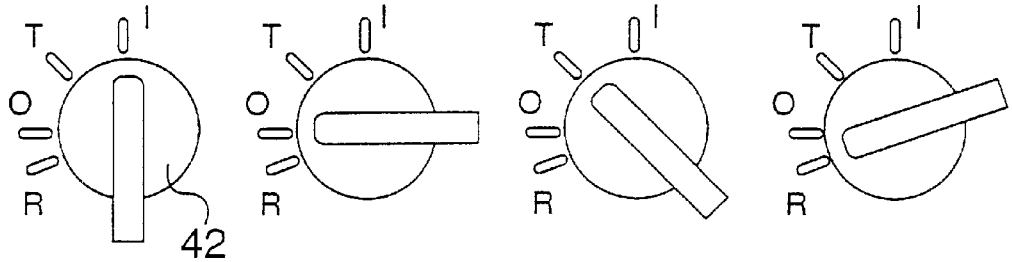
FIGS. 6A to 6D illustrate the positions of the knob in the states of the device shown in FIGS. 2 to 5.
Figure 2:
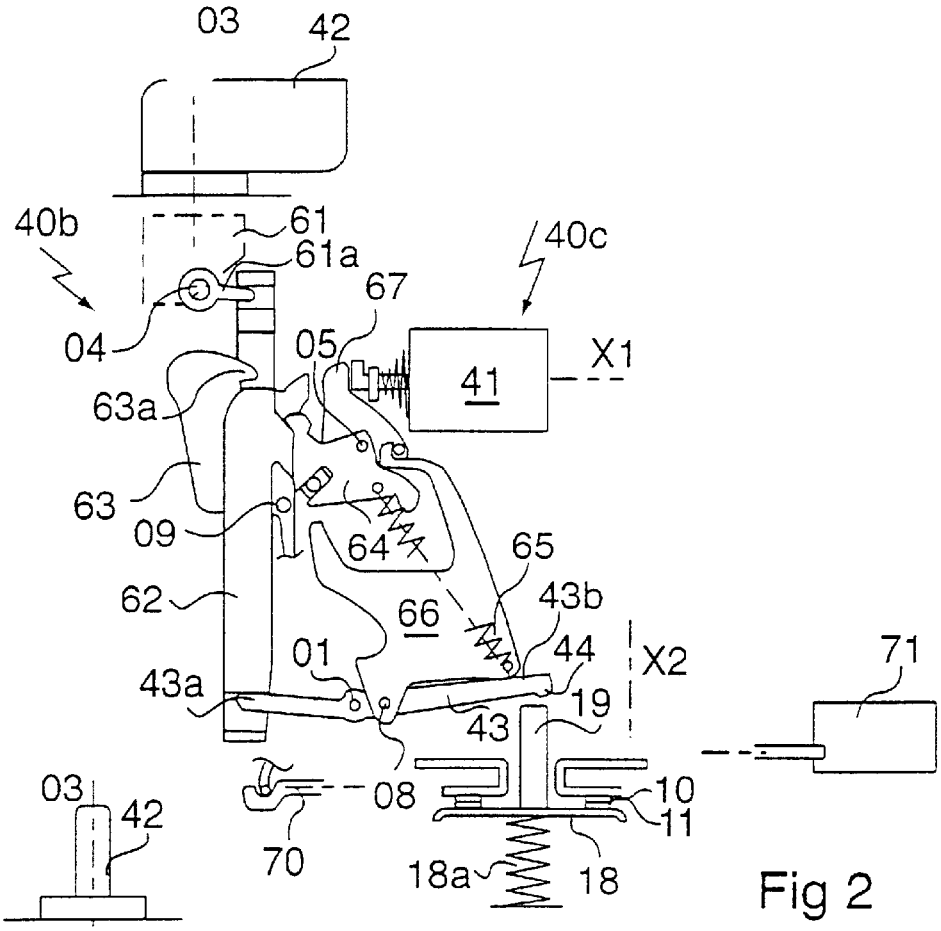
FIGS. 2 to 5 illustrate the circuit breaker in the "On" state, the "Off" state and the "Tripped" state and during resetting.
Figure 3:
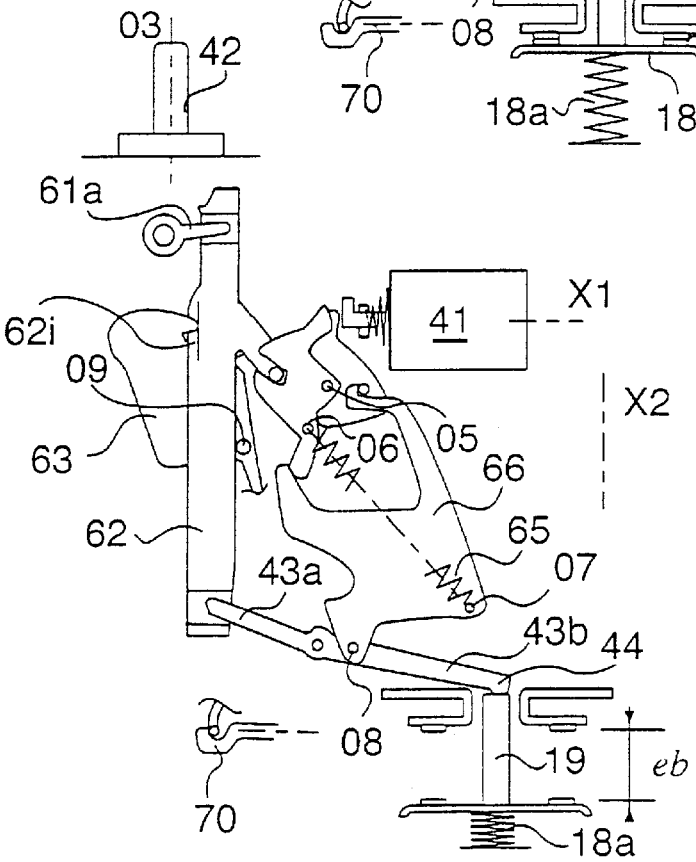
Figure 4:
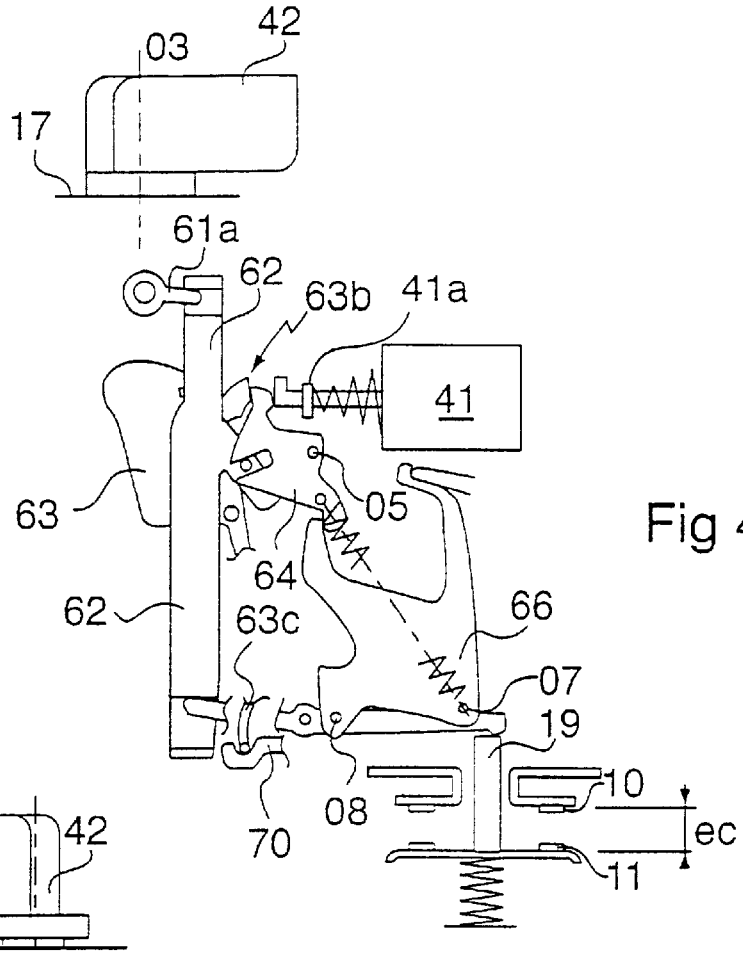
Figure 5:
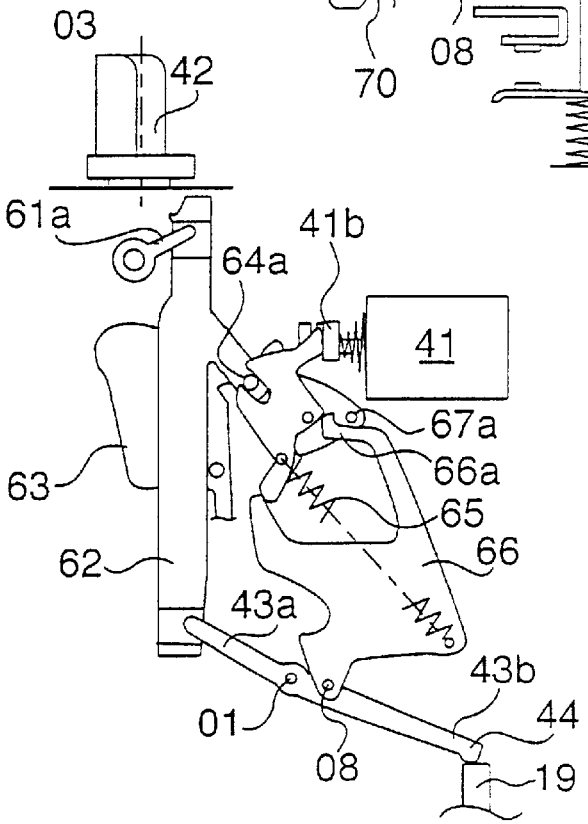

The connecting rod 62 is shown in more detail in FIG. 9. There is one position of the connecting rod for each position of the knob, shown in FIGS. 6A to 6D, namely the "On" position (FIG. 6A), the "Off" position (FIG. 6B), the "Tripped" position (FIG. 6C) and the "Reset" position (FIG. 6D). At its upper end located towards knob 42, the connecting rod 62 is provided with an opening 62*a* into which the operating finger 61*a* of the return system 61 fits, and a recess 62*b* which extends along the X2 direction and which is provided with straight slides 62*i* running along the X2 direction and with notches 62*c* setback from these slides to cooperate with a pivoting elastic lock 63.

The connecting rod 62 is fitted with arms 62*d* that fit together through a pin or tenons 62*e* provided with a slide or an oblong hole 64*a* of an oscillating lever 64 at their free end. At its lower end near the contacts, the connecting rod 62 comprises an opening 62*f* in which the end of the arm 43*a* of lever 43 fits to provide a bi-univocal link. Furthermore, the connecting rod is fitted with pins 62*g* that cooperate with slides 62*h* oriented along the X2 direction to guide it.

The oscillating lever 64 can rotate about an axis O5 and one end 65*a* of a helical compression spring 65 is fitted to it through a bearing axis O6. The oscillating lever 64 is also provided with an arm 64*b* located towards the contacts and an opposite arm 64*c* facing away from the contacts and towards the tripping device 41; the arm 64*b* is terminated with a contact surface 64*d* designed to cooperate in bearing with a control lever 66 and arm 64*c* is designed to cooperate with the contact surface 41*b* of the tripping device 41 in order to reset it.

The compression spring 65 (see FIG. 8) is hinged at its other end 65*b* close to its contacts about an axis O7 of a control lever 66 itself able to pivot around an axis O8. Axes O1, O2, O4, O5, O7 and O8 are fixed and parallel to each other, and are perpendicular to the plane of the drawing in FIGS. 2 to 5 and to X1 and X2, whereas the axes O6, O7 of the ends of the spring move as a function of the positions of the oscillating lever 64 and the control lever 66. As will be seen later, the spring 65 exerts a torque on lever 66 tending to trip it to open contacts and exerts a torque on lever 64 tending to trip it into the off or reset position.

The control lever 66 is acted upon by the part 40*c* of the mechanism and cooperates with part 40*b*. The lever 66 presses on the multipole lever 43 close to the free end 44 of the arm 43*b* of lever 43, through the end of an arm or an angle 66*b* on which the spring bearing axis O7 is located. The end 44 of the lever 43 has a different opening distance depending on whether it is acted upon by part 40*b* or 40*c* of the mechanism.

Lever 66 is fitted with a pawl 66*a* normally in contact with a pin or a hinge pin 67*a* of a latch 67. The shape of the control lever 66 is generally polygonal, and particularly trapezoidal, and an arm 66 fitted with pawl 66*a* and an arm 66*d* acting as a stop for the contact surface 64*d* on the oscillating lever 64 are latched to this lever, at the end opposite to axes O8 and O7.

The latch 67 is mounted free to pivot about on axis adjacent to and parallel to axis O5, or preferably about axis O5 itself, and it is moved by the cross-head of the sliding core 41*a* of the electromagnetic tripping device 41 acting on an arm 67*b*, the core being oriented to slide along direction X1.

The elastic lock 63 (see FIG. 11) is installed free to pivot around an axis O9 located close to one end of the connecting rod 62 located close to parts 40*b*, 40*c* of the mechanism. The lock 63 passes through an elongated central housing 62*b* in the connecting rod.

It comprises a heel 63*a* that can engage in contact with the notches 62*c* in the housing 62*b* of the connecting rod, and comprises a contact surface 63*b* into which the end of the core 41*a* of the tripping device 41 is applied, and an arm 63*c* that extends approximately along the X2 direction along the connecting rod. The arm 63*c* is fitted with a driving end 63*d* at its end near the contacts, that is engaged with a strip 70 free to move along the X1 direction. The strip 70 can activate at least one signaling device 71, for example with mechanical contacts, capable of switching off the power supply to the electromagnet coil 20 when the knob 42 is put into the "Off" position, and/or signaling the "On", "Off" or "Tripped" state of the switch. There are three positions ("On", "Off", "Tripped") of the strip 70 corresponding to the above three mentioned positions of the knob 42 and the connecting rod 62, that may for example be transferred to it by the lock.

The lock is acted upon by a tension spring 63*e*, which is also latched to a fixed point 63*f* and exerts a return force in the clockwise direction. The elasticity of the lock is such that an elastic effect is obtained at the heel 63*a* level through an internal elastic effect, possibly combined with the effect of a tension spring 63*g*, as in the case shown. The tripping part 40*c* of the mechanism 40 thus comprises the latch-in lever 67 and the control lever 66 and it dialogs with the oscillating lever 64, the spring 65 and the lock 63 of connecting rod 62.

The circuit breaker described operates as follows:

On (see FIG. 2): knob 42 is in the On position shown in FIG. 6A and it is assumed that the electromagnet 20 is energized so that lever 43 remains relaxed. The connecting rod 62 is moved into the low position by finger 61*a* rotating in the clockwise direction, such that the multipole lever 43 is switched over in the anti-clockwise direction releasing contact holders 19. The result is that the contacts 10, 11 for each pole are closed with a contact pressure exerted by spring 18*a*. Lock 63 is engaged on the connecting rod through its heel 63*a*. The tripping part 40*c* is held set in the state indicated in FIG. 4: the pusher 41*a* is retracted towards the right, the latch-in lever 67 is switched over in the clockwise direction and latched to the pawl 67*a* of the control lever 66 itself switched over in the anti-clockwise direction. Note that the oscillating lever 64 is moved in the anti-clockwise direction by the hinge pin 62*e* such that the latching axis O6 of spring 65 is approximately along the line between the pivoting axis O5 of lever 64 and the axis O7 at which the spring is latched to the control lever 66. The axis O6 is slightly offset towards the left of line O5-O7 to induce a clockwise rotation of the oscillating lever 64 during the trip takes place.

Off:

for manual control (see FIG. 3), the knob 42 is put into the off position shown in FIG. 6B. The finger 61*a* is then raised and, while the heel 63*a* of the lock 63 is released from the notches 62*c* of the connecting rod 62 due to the elasticity of the lock, the connecting rod can slide into an extreme high position (the position closest to the knob). The result is that the multipole lever 43 is switched over in the clockwise direction and that its end 44 is applied to the pushers 19 and moves them along the maximum travel distance, for example of the order of 5.5 mm, and it is applied to the pushers 19 such that the contacts open with a travel distance eb. This travel distance eb is sufficient to make the device capable of causing isolation. Note that the trip part 40*c* remains in the same state as in FIG. 4.

for automatic control by the electromagnet (see FIG. 13), the lever 51 pivots in the clockwise direction and the contacts are open with a travel distance of less than eb.

Trip (see FIG. 4):

in response to an overcurrent signal transmitted to the electromagnet 41, the pusher 41*a* moves towards the left and strikes the latch-in lever 67 that switches over in the anti-clockwise direction and releases pawl 67*a;* the control lever 66 moves in the clockwise direction acted upon by the compression spring 65, the free end 65*a* of which initially remaining fixed; the control lever 66 is applied to the multipole lever 43 over a travel distance of the order of 4.5 mm, such that the pushers 19 are pushed back and the contacts open with a travel distance ec. Note that ec is less than eb.

Secondly, the pusher 41*a* of the tripping device 41 continues its travel distance and arm 67*b* of the latch-in lever 67 strikes the contact surface 63*b* of the lock 63. This lock moves into an extreme anti-clockwise position showing that the trip has taken place, that it sends to the signaling strip 70 through driving end 63*d.*

The oscillating lever 64 returns in the clockwise direction to an intermediate position between its on and off positions; this return is due to the torque transferred to it by the upper end 65*a* of spring 65, as a result of the initial offset of O6 from line O5-O7. The intermediate position of the lever 64 is defined when its arm 64*b* reaches a limit stop in contact with arm 66*b* of the control lever 66, which itself stops in contact with a fixed limit stop 66*e;* the above mentioned position of the lever 64 defines an intermediate position of the connecting rod 62 controlled by hinge pin 62*e* through slide 64*a,* and consequently an intermediate position of the knob 42. After the contacts 71 have been acted upon, the strip is pulled towards the left by the arm 63*c* of lock 63 that is itself returned by its tension spring 63*e.*

Reset (see FIG. 5):

the knob 42 is rotated to a position beyond the off position in order to reset the mechanism after a trip, in order to displace the connecting rod 62 to an extreme low position which rotates the oscillating lever 64 in the clockwise direction, and this lever through its arm 64*c* pushes the tripping device pusher into its rest position (at the right in the figures), and through its arm 64*b* releases the lever 66 slightly in the anti-clockwise direction. The latch-in lever 67 returns to its latched position under the effect of a return spring (not shown) and when knob 42 returns to the Off position, the pawl 66*a* latches on the latch 67*a* and the switch is reset.

What is claimed is:

1. Circuit breaker control mechanism comprising a manually controlled part (40*b*) used to put the switch into the On and off and Reset positions, and a trip part (40*c*) comprising an electromagnetic tripping device (41), a pivoting latch-in lever (67) and a pivoting control lever with a pawl (66) normally held in position by the latch and acted upon by a trip spring (65), the tripping device pivoting the latch-in lever and detaching the control lever to open the contacts, in response to an overcurrent characterized by the fact that:

an oscillating lever (64) mounted free to pivot about an axis (O5) is coupled with the manually controlled part (40*b*), the trip spring (65) exerts an opening torque on the control lever (66) through a first bearing point (O7) and a return torque on the oscillating lever (64) through a second bearing point (O6).

2. Mechanism according to claim 1, characterized by the fact that the trip spring (65) is a compression spring, and the second bearing point (O6) of the spring (65) is put in the On position slightly offset from the line joining its first bearing point (O7) to the axis (O5) about which the oscillating lever (64) pivots, the offset moving the oscillating lever (64) into an intermediate position between its On position and its off position when a trip occurs.

3. Mechanism according to claim 1, characterized by the fact that the manual control part (40*b*) is fitted with a knob (42) and a sliding connecting rod (62) cooperating directly with the oscillating lever (64) and coupled to a multipole lever (43) to move the contacts, the connecting rod (62) and the knob (42) being able to move into an On position, an Off position and an intermediate trip position.

4. Mechanism according to claim 3, characterized by the fact that the sliding connecting rod (62) is associated with a pivoting lock (63), the pivoting lock being able to lock the connecting rod in the On position and being fitted with an arm (63*c*) coupled to a strip (70) designed to move the auxiliary contacts.

5. Mechanism according to claim 4, characterized by the fact that the pivoting lock (63) informs the strip (70) of the three positions ("On", "Off", and "Tripped" respectively).

6. Mechanism according to claim 5, characterized by the fact that the electromagnetic tripping device (41) initially trips the latch-in lever (67), and then puts the pivoting lock (63) into its tripped position.

7. Mechanism according to claim 1, characterized by the fact that the control lever (66) is fitted with a limit stop (66*d*) onto which the oscillating lever (64) is applied when the equipment is Tripped and/or off.

8. Mechanism according to claim 1, characterized by the fact that the manual control part (40*b*) is coupled to a single sliding strip (70) with three positions (On, Off and Tripped) to activate at least one signaling device (71).

* * * * *